US006483240B2

(12) United States Patent
O'Hare et al.

(10) Patent No.: US 6,483,240 B2
(45) Date of Patent: Nov. 19, 2002

(54) COMPACT AND STABILIZED ARC HIGH-PRESSURE MERCURY LAMP

(75) Inventors: Daniel Joseph O'Hare, Livermore, CA (US); Richard O. Shaffner, San Jose, CA (US); Richard P. Gilliard, Morgan Hill, CA (US)

(73) Assignee: PerkinElmer Optoelectronics, N.C., Inc, Sunnyvale, CA (US)

( * ) Notice: Subject to any disclaimer, the term of this patent is extended or adjusted under 35 U.S.C. 154(b) by 99 days.

(21) Appl. No.: 09/801,085

(22) Filed: Mar. 6, 2001

(65) Prior Publication Data

US 2002/0125823 A1 Sep. 12, 2002

(51) Int. Cl.[7] ..... H01J 61/073; H01J 63/02

(52) U.S. Cl. ..... 313/633; 313/491; 313/638; 313/639

(58) Field of Search ..... 313/491, 639, 313/638, 633, 574, 575, 113

(56) References Cited

U.S. PATENT DOCUMENTS 5,109,181 A 4/1992 Fischer et al.
5,184,044 A * 2/1993 Thomas ..... 313/638
5,621,267 A 4/1997 Shaffner et al.
5,798,612 A * 8/1998 Dirks ..... 313/642
6,060,830 A 5/2000 Sugitani et al.
6,211,616 B1 * 3/2001 Takeuti et al. ..... 313/637

* cited by examiner

*Primary Examiner*—David Martin
*Assistant Examiner*—Dameon E. Levi
(74) *Attorney, Agent, or Firm*—Thomas E. Schatzel; Law Offices of Thomas E. Schatzel

(57) ABSTRACT

A high pressure mercury lamp comprises a quartz envelope that contains an atmosphere and a pair of arc-discharge electrodes. These are coil-wound tungsten that has been doped to grain-stabilize the tungsten crystalline structure, e.g., with potassium or potassium and alumina. Preferred potassium doping levels of the tungsten material are in the range of 35–75 ppm. A suitable commercial product of alumina and potassium doped tungsten material is Type BSD-Sylvania. The atmosphere generally comprises a rare gas like xenon, to which is added no more than 0.2 mg/mm$^3$ of mercury so as to keep operating pressure under 200 bar (197 atm). But the electrical power applied is sufficient to maintain arc power loadings of at least 150 watts/mm. The resultant wall loading is more than 0.8 watts/mm$^2$, and lamp operating-power levels can be greater than 150 watts.

5 Claims, 1 Drawing Sheet

COMPACT AND STABILIZED ARC HIGH-PRESSURE MERCURY LAMP

BACKGROUND OF THE INVENTION

1. Field of the Invention

Figure 1:
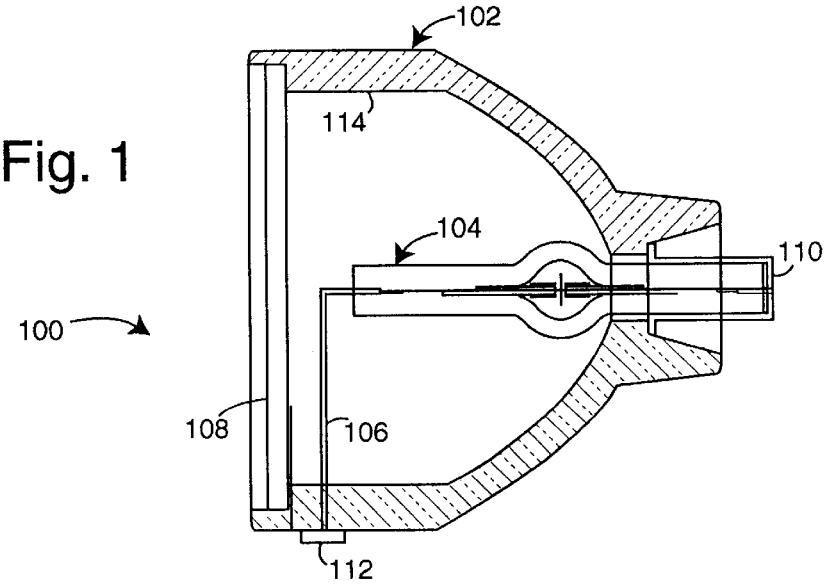

The invention relates generally to high-pressure mercury arc lamps, and specifically to lamps with arc loadings in excess of 150 watts/mm, wall loading of more than 0.8 watts/mm, mercury loading pressures of at least 0.16 mg/mm$^3$, and lamp operating-power levels greater than 150 watts. And more in particular where the mercury is less than 0.2 mg/mm$^3$ to reduce pressure to under 200 bar (197 atm), and potassium doping of the tungsten electrodes is used to stabilize the electric arc.

2. Description of the Prior Art

Video projection and fiber illumination systems have benefitted from the ever more powerful arc lamps that have become commercially available over the last several years. Long life is also a critical benefit necessary for the commercial markets. Very often long life and high power levels are at odds with one another.

High operating pressures of 200 bar (197 atm) within mercury lamps operate to concentrate the electrical arc and therefore increase the brilliance of the light output. The addition of sufficient mercury to achieve the highest operating pressure results in a better visual color spectrum output, especially in the reds. Adding halogen helps control or delay envelope blackening, but too much can cause electrode etching.

Akihiko Sugitani, et al., describe a super high pressure mercury lamp in U.S. Pat. No. 6,060,830, issued May 9, 2000, e.g., exceeding 200 bar (197 atm). The lamp has at least 0.16 mg/mm$^3$ mercury and a rare gas. The discharge tube has a tube wall load of at least 0.8 watts/mm$^2$ and includes at least one metal halide with an ionozation potential at most 0.87 times as high as the mercury and added in the range of $2 \times 10^{-4}$ to $7 \times 10^{-2}$ $\mu$mole/mm$^3$. Such Patent recognizes the arc stability problems and tries to offer a solution.

In general, prior-art ultra high pressure lamps are limited to arc loadings of about 150 watts/mm and maximum power levels of 150-watts. Extreme mercury pressures exceeding 0.2 mg/mm$^3$ of these lamps and high arc temperatures, universally destabilize the arc discharge.

SUMMARY OF THE PRESENT INVENTION

Briefly, a high pressure mercury lamp comprises a quartz envelope that contains an atmosphere and a pair of arc-discharge electrodes. These are coil-wound tungsten that has been doped to grain-stabilize the tungsten crystalline structure, e.g., with potassium or potassium and alumina. Preferred potassium doping levels of the tungsten material are in the range of 5–65 ppm. A suitable commercial product of alumina and potassium doped tungsten material is NON-SAG. The atmosphere generally comprises a rare gas like xenon, to which is added no more than 0.2 mg/mm$^3$ of mercury so as to keep operating pressure under 200 bar (197 atm). But the electrical power applied is sufficient to maintain arc power loadings of at least 150 watts/mm. The resultant wall loading is more than 0.8 watts/mm$^2$, and lamp operating-power levels can be greater than 150 watts.

An advantage of the present invention is that a mercury lamp is provided that operates at slightly lower mercury pressure but maintains luminous efficacy and spectral red content at the higher power level.

Another advantage of the present invention is that a mercury lamp is provided that can operate in excess of 150 watts.

A further advantage of the present invention is that a mercury lamp is provided with higher halogen densities.

A still further advantage of the present invention is that a mercury lamp is provided that has a operational long life.

These and other objects and advantages of the present invention will no doubt become obvious to those of ordinary skill in the art after having read the following detailed description of the preferred embodiments which are illustrated in the drawing figures.

IN THE DRAWINGS

Figure 2:
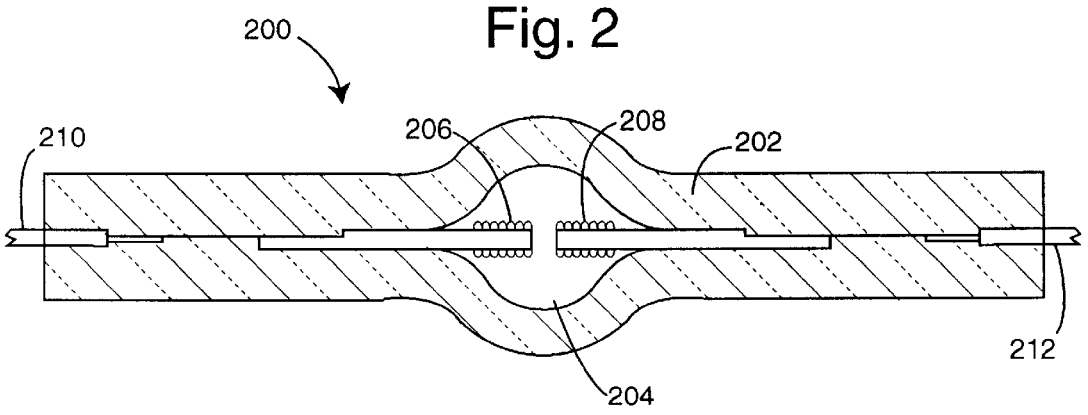

FIG. 1 is cross sectional view of a reflector lamp embodiment of the present invention; and FIG. 2 is cross sectional diagram of a high pressure mercury lamp embodiment of the present invention.

DETAILED DESCRIPTION OF THE PREFERRED EMBODIMENT

FIG. 1 illustrates a reflector lamp embodiment of the present invention, and is referred to herein by the general reference numeral 100. The reflector lamp 100 comprises a reflector 102 into which is set a high pressure mercury lamp 104. A strut 106 connects one electrode to an external power source and supports the otherwise free end of the lamp. A window 108 keeps dust and dirt off the inside reflector surface. Power is applied to a base connection 110 and a side connection 112. A dichroic coating 114 is preferred for lamps operated at more than 150 watts to prevent reflector failure. Such a dichroic coating is described by one of the present inventors, Richard O. Shaffner, et al., in U.S. Pat. No. 5,621,267, issued Apr. 16, 1997. Such Patent and all others mentioned herein are incorporated by reference.

A nickel electro-formed reflector or glass-ceramic reflector with such dichroic coatings optimized for ultra-violet is preferred for UV-curing and projection applications.

FIG. 2 illustrates a high pressure mercury short-arc lamp embodiment of the present invention, and is referred to herein by the general reference numeral 200. Such is preferably used in the reflector lamp 100 of FIG. 1. The lamp 200 comprises a quartz envelope 202 that contains an atmosphere 204. A pair of arc-discharge electrodes 206 and 208 are coil-wound tungsten that has been doped with potassium to grain-stabilize the tungsten crystalline structure. Such substantially improves arc-discharge stability. Preferred potassium, doping levels of the tungsten material are in the range of 35–75 ppm. A suitable commercial product of alumina and potassium doped tungsten material is readily available through various tungsten manufacturers. The conventional use of such material is in incandescent lamps. The alumina and potassium dopants are believed to help establish small grain boundaries populated with bubble voids. During operation, grain deformation and growth is controlled or stopped altogether. Such leads to arc discharge stability that is important in optical systems.

A pair of conductors 210 and 212 feed in the electrical operating power and are sealed to the quartz envelope 202.

The atmosphere 204 generally comprises a rare gas like xenon, to which is added no more than 0.2 mg/mm$^3$ of mercury so as to keep operating pressure under 200 bar (197 atm). But the electrical power applied to conductors 210 and 212 is sufficient to maintain arc power loadings of at least 150 watts/mm. The resultant wall loading is more than 0.8 watts/mm$^2$, and lamp operating-power levels can be greater than 150 watts.

Erosion of the electrodes 206 and 208 is preferably controlled by adding 0.05% W to 0.25% W of indium or thallium metal to the mercury.

Embodiments of the present invention are all generally characterized by their reduction in mercury pressure level and increase in the operating power level in order to maintain radiating efficacy of the arc discharge. Halogen densities greater than $10^{-4}$ micromoles/mm$^3$ and the reduced mercury vapor pressure level allow a slightly larger arc diameter and a reduction in arc temperature. This in combination with the stabilizing effect of the potassium-doped tungsten electrodes improves arc stability over the life of lamps with power levels exceeding 150 watts.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A high pressure mercury lamp with compact arc and stabilized arc discharge with high luminous efficacy running at power levels exceeding 150 watts, comprising:

a pair of opposed tungsten electrodes with a potassium dopant for providing a fixation of tungsten grains;

a mercury lamp loading of less than 0.2 mg/mm$^3$; and a halogen density exceeding $10^{-4}$ micromoles/mm$^3$;

wherein, wall loading of the lamp is at least 0.8 watts/mm$^2$ with mercury loading in excess of 0.16 mg/mm$^3$ and a potassium dopant level of the electrodes is 35–75 ppm.

2. The lamp of claim 1, wherein:

the pair of opposed potassium-doped tungsten electrodes further are comprised of a commercial material equivalent to Type BSD-Sylvania as marketed by OSRAM (Munich, Germany).

3. The lamp of claim 1, further comprising:

a dichroic-coated ceramic reflector for operation of the lamp in excess of 150-watts without reflector failure.

4. The lamp of claim 1, further comprising:

a grain-stabilized tungsten providing for spatial arc discharge stability when arc power loading exceeds 150 watts/mm.

5. A high pressure mercury lamp, comprising:

a quartz envelope with an operational wall loading of at least 0.8 watts/mm$^2$;

a halogen density exceeding $10^{-4}$ micromoles/mm$^3$;

a mercury lamp loading in the range of 0.16 to 0.2 mg/mm$^3$ resulting in an operational pressure of less than 200 bar (197 atm); and a pair of tungsten electrodes doped with a grain-structure-fixation additive for providing arc-discharge stabilization.

* * * * *